United States Patent [19]

Wietschorke et al.

[11] Patent Number: 4,556,028

[45] Date of Patent: Dec. 3, 1985

[54] ARRANGEMENT FOR REGULATING THE IDLING SPEED OF AN INTERNAL COMBUSTION ENGINE

[75] Inventors: Stephan Wietschorke, Usingen; Horst Schlick, Schwalbach, both of Fed. Rep. of Germany

[73] Assignee: VDO Adolf Schindling AG, Frankfurt am Main, Fed. Rep. of Germany

[21] Appl. No.: 573,720

[22] Filed: Jan. 25, 1984

[30] Foreign Application Priority Data

Jan. 26, 1983 [DE] Fed. Rep. of Germany ..... 3302435

[51] Int. Cl.[4] ..... F02B 3/00

[52] U.S. Cl. ..... 123/339; 251/129.02; 251/129.21

[58] Field of Search ..... 123/339, 585; 251/129, 251/141

[56] References Cited

U.S. PATENT DOCUMENTS 2,859,951 11/1958 Wren, Jr. ..... 123/339
3,146,844 9/1964 Carlson ..... 123/339
4,251,052 2/1981 Hertfelder et al. ..... 251/129
4,385,603 5/1983 Bonse et al. ..... 123/339

FOREIGN PATENT DOCUMENTS 2921832 12/1979 Fed. Rep. of Germany ..... 251/141
0053660 3/1983 Japan ..... 123/339

*Primary Examiner*—Parshotam S. Lall
*Attorney, Agent, or Firm*—Martin A. Farber

[57] ABSTRACT

In an arrangement for regulating the idling speed of rotation of an internal combustion engine by influencing the intake by means of an electromagnetic control element, a ferromagnetic actuating element is provided within the field of influence of a solenoid. There also acts on the actuating element an auxiliary spring which moves a valve element against the force of a return spring in order to establish an average rate of flow of air when the solenoid is without current. If the solenoid is acted on by current, the actuating element is moved away from a stop so that the valve element can adjust itself only under the influence of the force of the solenoid and of the return spring.

5 Claims, 1 Drawing Figure

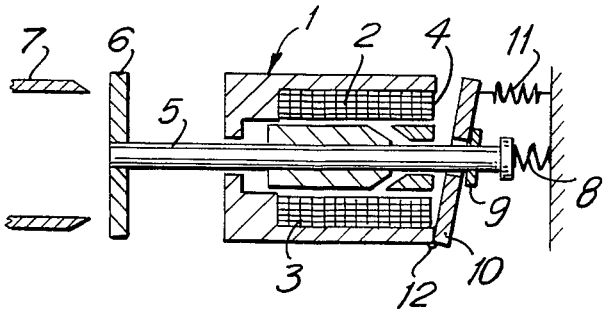
7
6
1
2
4
11
5
8
9
3
12
10

ARRANGEMENT FOR REGULATING THE IDLING SPEED OF AN INTERNAL COMBUSTION ENGINE

BACKGROUND OF THE INVENTION

The invention relates to an arrangement for regulating the idling speed of an internal combustion engine by influencing the intake by means of an electromechanical control element which has a valve element which is movable by a solenoid in opposition to the force of a return spring.

Such arrangements are used for regulating the idling speed in order to establish, particularly in automotive vehicles, the lowest possible speed which results in favorable consumption and emission values. If the intake of the internal combustion engine remains constant, variations in the idling speed may occur, in particular, due to different loads which are produced by auxiliary apparatus. In addition to this, at low idling speed the operating condition of an internal combustion engine is close to the unstable speed range in which the engine may die out upon further additional load. For this reason, the flow of air, or intake, upon idling is not set at a fixed value but is regulated according to the variations in the idling speed. For this purpose, the solenoid is acted on by a setting current which is formed, inter alia, as a function of the actual speed of rotation and effects such an adjustment of the valve element, which is connected to the solenoid, that the actual speed of rotation reaches a predetermined desired speed of rotation substantially independently of disturbance variables.

Normally, known arrangements for regulating the idling speed are specifically so developed that when the solenoids are without current the valve element is held in the fully open or fully closed position by the return spring. Only when the solenoid is acted on by the setting current does the valve element move, against the force of the return spring, into a central position located between these two end positions until a balancing of forces prevails between the magnetic force and the force of the return spring.

Upon a failure of the device which produces the setting current or a disturbance in the solenoid, the internal combustion engine is, as a result, operated with the maximum air flow possible within the idling range, which normally results in an undesirably high idling speed, or else with the minimum air flow, with the danger of the engine dying.

The present invention therefore has as its object so further to develop an arrangement for regulating the idling speed of the aforementioned type that, even upon falure of the solenoid or of the current actuating it, a medium idling air flow is established which permits expectation of idling operation which satisfies most cases of load of the internal combustion engine.

SUMMARY OF THE INVENTION

In accordance with the invention, a ferromagnetic actuating element (disk 10) is arranged within the sphere of influence of the solenoid (1) and is displaceable with respect to the valve element (6), by means of at least one auxiliary spring (11), as far as a stop (9) which is firmly attached to the valve element, and said auxiliary spring is so dimensioned in relation to the return spring (8) that the valve element (6) is held in a position of average air flow, when the solenoid is without current, by the auxiliary spring (11) and the return spring (8) which act upon it in opposite directions.

In accordance with the invention, the result is obtained that with an arrangement which is favorable from a manufacturing standpoint, inexpensive and requires no further electrical switch elements, the flow of air in idling operation is set to an average value when the solenoid fails. The automatic establishing of an average air flow when the solenoid is without current is effected by the action of the auxiliary spring via the actuating element on the value element, namely in opposition to the force of the return spring. When the solenoids are without current, the actuating element is, namely, held against the stop by the auxiliary spring, thereby placing the valve element in a central position, while without the auxiliary spring the valve element would be held in an end position by the action of the return spring. In this central position of the valve element, a balancing of forces is established by the deformations of the return spring and auxiliary spring which correspond to this position. If the solenoid, on the other hand, is acted on by a setting current when the control is duly functioning, this current attracts the ferromagnetic actuating element in opposition to the force of the auxiliary spring so that the actuating element moves away from the stop. As a result, the valve element is set independently of the actuating element and the auxiliary spring, solely in accordance with the balance of forces between the solenoid and the return spring, as customary. The setting characteristic of this arrangement is therefore to this extent advantageously not changed by the auxiliary spring and the ferromagnetic actuating element. The indicated function of the actuating element presupposes such a development of the solenoid that the magnetic fluxes from the solenoid can pass into the region of the ferromagnetic actuating element so as to produce the desired action on it. The solenoid therefore should not be magnetically completely closed in the region of the actuating element. By this development of the solenoid and the arrangement of the ferromagnetic actuating element within the field influenced by it, displacement of the actuating element by the solenoid is therefore possible when the solenoid is acted on by normal setting currents.

In accordance with the invention, an arrangement having an electromagnet within which a core connected to the valve element is displaceable is characterized by the fact that the solenoid (1) has a magnetically non-closed end (4) which is mounted opposite the ferromagnetic actuating element (10).

In one particularly suitable embodiment, the ferromagnetic actuating element is formed of a perforated disk (10) through which there passes a solenoid bar (5) which rigidly connects the valve element (6), the displaceable core (3) of the magnet and the stop (9) to each other. This arrangement is compact and can be manufactured at low cost, since the solenoid bar need, for all practical purposes, only be provided with an additional stop as compared with a customary design. The ferromagnetic actuating element is arranged approximately coaxial to the solenoid bar along the extension of the solenoid.

In one particularly uncomplicated arrangement, the disk (10) which represents the ferromagnetic actuating element is swingable about an axis (12) which is located on the magnetically non-closed end (4) of the solenoid (1), and the auxiliary spring (11) acts on an end of the disk which is opposite the axis of swing (12). In this arrangement therefore, when the solenoid is without current, the disk swings away from the end of the solenoid, due to the force of the auxiliary spring at the end on which the auxiliary spring acts, and rests against the stop. When the solenoid is acted on by the setting current, the disk swings onto the end which until then has not been magnetically closed and moves away from the stop. As soon as the disk rests against the end of the solenoid, the magnetic flux of the latter can develop in advantageous manner on the front side of the ferromagnetic disk so that the efficiency of the solenoid is high.

In one variant of the arrangement, the disk can also be displaceable parallel to the solenoid bar. In this case, therefore, the parallel guidance takes the place of the axis of swing of the first-mentioned embodiment. The disk is, in this case, acted on symmetrically mechanically and magnetically, which may be advantageous in individual cases of use.

BRIEF DESCRIPTION OF THE DRAWING

With the above and other objects in view, the invention will be described by example by reference to the drawing showing in the only FIGURE an illustrative embodiment of the arrangement having a swingable disk.

DETAILED DESCRIPTION OF THE PREFERRED EMBODIMENT

The drawing shows a solenoid having a coil 2 and displaceable core 3. The solenoid is open on its end 4, i.e. not closed by any ferromagnetic housing part.

The core which is fastened to a solenoid bar 5 is displaceable together with the bar. On the left-hand end, as seen in the drawing, the solenoid bar bears a valve element 6 to which there corresponds a valve seat 7 in the idling air path of an internal combustion engine, not shown in the drawing.

On the right-hand end of the solenoid, as seen in the drawing, there acts a return spring 8 which in the present case as compression spring seeks to press the valve element 6 into the closed position.

Also on the right-hand side of the solenoid bar there is a stop 9 developed on it. A swingable ferromagnetic disk 10 is pulled by the force of an auxiliary spring 11 against the stop in the position shown in the drawing. The axis of swing of the disk is designated 12.

In the position shown, the solenoid 1 is without current, so that only the force of the auxiliary spring acts on the disk 10. The auxiliary spring pulls the solenoid rod 5, via the stop 9, to the right into an open position until a balancing of forces prevails between the auxiliary spring and the return spring, which opposes this movement. A central idling air flow is thereby established at the valve.

While therefore the position shown corresponds to the case of disturbance, upon the normal operation of the solenoid the latter is acted on by the setting current, so that the ferromagnetic disk 10 is pulled against the end 4 of the solenoid. This swinging motion takes place against the force of the auxiliary spring 11. In this way, the disk 10 moves away from the stop 9, so that now only the forces exerted by the core 3 and the return spring 8 act on the solenoid rod until these forces are in equilibrium. The position of the valve element therefore corresponds, in the customary normal cases of operation, to the setting current in the solenoid for a predetermined characteristic curve of the return spring 8.

In one variant of the embodiment shown, the auxiliary spring 11 can also be arranged as compression spring between the disk and the end of the solenoid. As in the first embodiment, the disk is supported on the solenoid bar 5, also known as a valve stem.

We claim:

1. In a system for regulating the idling speed of an internal combustion engine by control of intake by means of an electromechanical control unit, the control unit having a valve element which is movable by a solenoid in opposition to the force of a return spring, the improvement comprising:

a valve element having a stem, a solenoid disposed about said stem for displacing said valve element, a stop firmly attached to said stem, a ferromagnetic actuating element disposed about said stem between said solenoid and said stop, a return spring contacting an end of said stem, means comprising at least one auxiliary spring for moving said actuating element with respect to the valve element, as far as said stop, and wherein said auxiliary spring is so sized with respect to said return spring that when the solenoid is without current, the valve element is held in a position of average air flow by the auxiliary spring and the return spring which act upon said valve element in opposite directions.

2. In a system for regulating the idling speed of an internal combustion engine as set forth in claim 1, the improvement wherein said solenoid encloses a core connected to the stem of said valve element, said core being displaceable within said solenoid, said solenoid has a magnetically non-closed end, said core passing through said solenoid, there being a ferromagnetic actuating element mounted on said stem facing said non-closed end.

3. In a system for regulating the idling speed of an internal combustion engine as set forth in claim 1, the improvement wherein the ferromagnetic actuating element is formed as a perforated disc, there being a displaceable core disposed within said solenoid, said stem serves as a solenoid bar, supports said core and passes through said perforated disc and rigidly connects said valve element, the displaceable core of the magnet and the stop to each other.

4. In a system for regulating the idling speed of an internal combustion engine as set forth in claim 3, the improvement wherein said solenoid has a magnetically non-closed end, said disc constituting said ferromagnetic actuating element is pivotable about a pivot axis located on said stem and at the magnetically non-closed end of the solenoid, and said auxiliary spring acts on an end of the disc which is opposite the pivot axis.

5. In a system for regulating the idling speed of an internal combustion engine as set forth in claim 3, the improvement wherein said disc is also displaceable parallel to the solenoid bar.

* * * * *